United States Patent [19]

Howell

[11] Patent Number: 4,717,796

[45] Date of Patent: Jan. 5, 1988

[54] LOW VOLTAGE VACUUM CIRCUIT INTERRUPTER

[75] Inventor: Edward K. Howell, Simsbury, Conn.

[73] Assignee: General Electric Company, New York, N.Y.

[21] Appl. No.: 21,363

[22] Filed: Mar. 2, 1987

Related U.S. Application Data

[62] Division of Ser. No. 770,931, Aug. 30, 1985.

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,620,122 10/1986 Howell ..... 310/328

*Primary Examiner*—Robert S. Macon

*Attorney, Agent, or Firm*—Richard A. Menelly; Walter C. Bernkopf; Fred Jacob

[57] ABSTRACT

A solid state switch connected across a pair of separable contacts for eliminating arcing across the contacts allows the contacts and the contact driver to be enclosed within an evacuated envelope. The vacuum environment allows the use of an inexpensive, highly conductive contact material, such as copper, without fear of chemical reaction.

10 Claims, 1 Drawing Figure

LOW VOLTAGE VACUUM CIRCUIT INTERRUPTER

This is a continuation of application Ser. No. 770,931, filed Aug. 30, 1985.

BACKGROUND OF THE INVENTION

The provision of a solid state switch across a pair of separable contacts to reduce arcing between the contacts, when separated, is disclosed within U.S. patent application Ser. No. 610,947 filed May 16, 1984 entitled "Solid State Current Limiting Interrupter" in the name of E. K. Howell and now abandoned. This application is incorporated herein for purposes of reference and should be reviewed for a good description of the circuit components used within the solid state switch.

The absence of an arc between the contacts, when separated, allows smaller contacts which in turn are more readily separated in the early stages of the current waveform to further reduce contact heating and deterioration. U.S. patent application Ser. No. 684,307 filed Dec. 20, 1984 entitled "High Speed Contact Driver For Circuit Interrupter Device" now abandoned and U.S. Pat. No. 4,620,122, entitled "Piezoelectric Contact Driver For Circuit Interrupters", both in the name of E. K. Howell, disclose contact drivers for rapid circuit interruption by means of a pair of fixed contacts and a bridging contact operated by a contact driver. Both of the applications are also incorporated herein for purposes of reference. The use of the solid state switch in combination with the high speed contact driver to separate the contacts allows the solid state circuit components to be reduced in rating and hence more economically feasible. U.S. Pat. No. 4,607,148 entitled "Change Of State Contact Material For Electric Circuit Interrupters", also in the name of E. K. Howell, describes a contact structure that allows for a reduction in the contact holding force which is required to provide low contact resistance between the contacts. This results in the use of smaller contacts and contact holding springs. This application is incorporated herein for purposes of reference and should be reviewed for a good understanding of the materials and arrangement used to promote these benefits.

By the synergistic combination of a solid state switch, high speed contact driver and change of state electrode materials, the size of the contacts and the means for separating the contacts can be reduced sufficiently to enable containment within an evacuated envelope. The use of the evacuated envelope now allows either the fixed contact pair or the bridging contact to be fabricated from copper metal rather than silver. The copper provides good electrical conduction between the contacts along with a substantial reduction in materials costs. The copper remains oxide-free under the vacuum contained within the sealed envelope as well as when reducing-type gases are employed instead of vacuum.

SUMMARY OF THE INVENTION

A low voltage vacuum interrupter consisting of a pair of fixed contacts and a bridging contact under the control of a high speed contact driver are arranged within an evacuated envelope. The fixed contacts comprise copper metal while the bridging contact comprises a change of state layered metal contact. A solid state switch connected across the fixed contact pair allows the contacts to be separated without the occurrence of any arc whatsoever.

BRIEF DESCRIPTION OF THE DRAWINGS

The FIGURE is a side sectional view of a low voltage vacuum interrupter according to the invention.

DESCRIPTION OF THE PREFERRED EMBODIMENT

Figure 1:
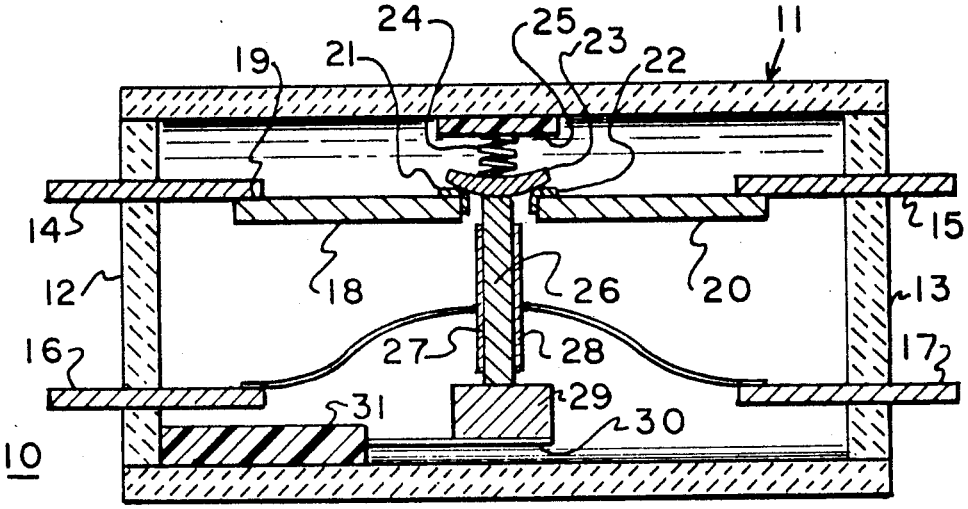

A low voltage vacuum circuit interrupter 10 hereafter "vacuum interrupter" is depicted in FIG. 1 and consists of a hermetically sealed envelope 11 of a metal, glass or ceramic construction which is closed at the ends by means of endwalls 12 and 13. The housing is either cylindrical or rectangular in configuration and is evacuated to remove most of the air as is common with vacuum interrupters of the higher voltage type. For purposes of this disclosure, a low voltage vacuum interrupter is one used for interrupting circuit currents with circuit voltages less than 1000 volts. An example of a medium voltage vacuum interrupter is described in U.S. Pat. No. 3,014,110 in the name of James D. Cobine, which patent is incorporated herein for purposes of reference for its teachings of a state of the art medium voltage vacuum interrupter device. The low voltage vacuum interrupter 10 differs from the medium voltage vacuum interrupter by the provision of a pair of lead-in conductors 14, 15 for electrical connection with a pair of fixed contacts 21, 22 attached to the ends of a corresponding pair of shaped metal bars 18, 20 by means of a weld as indicated at 19. A bridging contact 23 is arranged across the fixed contact pair and is held in good electrical connection therewith by means of a contact spring 24 arranged on a support 25. To separate the bridging contact from the fixed contact pair, a piezoelectric bar 26 having a pair of electrodes 27, 28 on either side for attachment to lead-in wires 16, 17, is arranged for extension in its longitudinal direction transverse to the electrodes for striking the bridging contact and driving it out of electrical connection with the fixed contact pair. The piezoelectric bar is positioned between the bridging contact and a metal base 29 which in turn is supported on a cantilever spring 30. The cantilever spring is arranged on a support 31 which is fixedly attached to the envelope 11. The operation of the piezoelectric bar 26 is described within the aforementioned U.S. Pat. No. 4,620,122 entitled "Piezoelectric Contact Driver For Circuit Interrupters". When the fixed contact pair 21, 22 are electrically connected in parallel with a solid state switch, the circuit current transferring between lead-in wires 14, 15 across the contacts is first diverted through the solid state switch before a DC voltage pulse is applied across lead-in wires 16, 17 to drive the bridging contact away from electrical connection with the contact pair. Since most of the circuit current diverts through the solid state switch, only a small amount of current passes through the contacts at the instant of separation. This small amount of current is insufficient to establish an arc, particularly within the high vacuum environment maintained within the evacuated envelope 11. The high vacuum environment substantially reduces the possibility of reignition across the separated contacts when the solid state which turns off and circuit voltage reoccurs across the fixed contact pair. An auxiliary switch (not shown) is usually connected in series with the fixed contact pair to completely interrupt the circuit path through the contacts after the solid state switch is turned off.

I claim:

1. A vacuum circuit interrupter comprising:

a hermetically sealed closure;

separable contacts within said closure for interrupting current through an external circuit upon command;

contact separation means within said closure for separating said contacts in response to an electrical control signal;

said separation means comprising a piezoelectric driver element arranged for moving one of said contacts out of electric contact with the other of said contacts when said control signal is applied to said piezoelectric element.

2. The vacuum circuit interrupter of claim 1 including bias means within said closure for holding said contacts in electric circuit relation with said external circuit in the absence of said control signal.

3. The vacuum circuit interrupter of claim 2 wherein one of said contacts comprises a bridging contact and the other of said contacts comprise a pair of spaced fixed contacts, said bridging contact arranged in electric connection with both of said fixed contacts in the absence of said control signal.

4. The vacuum circuit interrupter of claim 3 further including a support block at one end of said piezoelectric driver element for providing a first mass to said one end of said piezoelectric driver element, said bridging contact being arranged at an opposite end of said piezoelectric driver element, said bridging contact providing a second mass to said piezoelectric driver element, said first mass being greater than said second mass.

5. The vacuum circuit interrupter of claim 4 wherein said support block is carried by a cantilever spring in force-opposition to said bias means.

6. The vacuum circuit interrupter of claim 3 further including a first pair of electric lead-in wires, one on either side of said closure for providing external electrical connection with said pair of fixed contacts and a second pair of electric lead-in wires one on either side of said closure, for providing external electrical connection with said piezoelectric element.

7. The vacuum circuit interrupter of claim 1 wherein said closure is at least partially evacuated for preventing arcing between said separable contacts.

8. The vacuum circuit interrupter of claim 1 wherein said closure contains a non-oxidizing gas fill.

9. The vacuum circuit interrupter of claim 3 wherein said bias means comprises a compression spring mounted at one end to a side of said closure and attached to said bridging contact at an opposite end.

10. The vacuum circuit interrupter of claim 1 further including a solid state switch connected across said separable contacts for transferring said circuit current away from said contacts prior to or during separation of said contacts to interrupt said circuit current.

* * * * *